US011882941B2

(12) United States Patent
Ho

(10) Patent No.: US 11,882,941 B2
(45) Date of Patent: Jan. 30, 2024

(54) CHAIR STRUCTURE WITH ELECTRONICS SUPPORT FRAME

(71) Applicant: OXTI Pte Ltd, Singapore (SG)

(72) Inventor: Chih-Feng Ho, Singapore (SG)

(73) Assignee: OXTI PTE LTD, Singapore (SG)

( * ) Notice: Subject to any disclaimer, the term of this patent is extended or adjusted under 35 U.S.C. 154(b) by 0 days.

(21) Appl. No.: 17/838,281

(22) Filed: Jun. 13, 2022

(65) Prior Publication Data

US 2023/0397732 A1 Dec. 14, 2023

(51) Int. Cl.
*A47C 7/62* (2006.01)
*A47C 7/72* (2006.01)

(52) U.S. Cl.
CPC ..... *A47C 7/62* (2013.01); *A47C 7/723* (2018.08)

(58) Field of Classification Search
CPC .. A47C 7/42; A47C 7/723; A47C 7/62; A47B 83/02
See application file for complete search history.

(56) References Cited

U.S. PATENT DOCUMENTS

| | | | | |
|---|---|---|---|---|
| 8,955,905 | B2 * | 2/2015 | Boenigk | A47C 7/70 297/173 |
| 2015/0108317 | A1 * | 4/2015 | Cruz | B62B 9/26 248/479 |
| 2018/0352959 | A1 * | 12/2018 | Zhang | A47C 1/03 |
| 2021/0266427 | A1 * | 8/2021 | Kidakarn | H04N 23/57 |

FOREIGN PATENT DOCUMENTS

| | | | | |
|---|---|---|---|---|
| CN | 111743339 | A * | 10/2020 | A47C 7/006 |
| CN | 112741437 | A * | 5/2021 | A47C 1/02 |
| CN | 113616014 | A * | 11/2021 | |
| CN | 113892775 | A * | 1/2022 | |
| CN | 113895362 | A * | 1/2022 | |
| CN | 113951655 | A * | 1/2022 | |
| KR | 20190132843 | A * | 7/2019 | |
| KR | 20190076349 | A * | 11/2019 | |

* cited by examiner

*Primary Examiner* — Timothy J Brindley
(74) *Attorney, Agent, or Firm* — Leong C. Lei

(57) ABSTRACT

A chair structure with electronics support frame includes: a chair body, which includes an armrest; and an electronics support frame, which is located at one side of the armrest. The electronics support frame includes a mounting piece, a foldable pedestal, a claw part, a drive mechanism, and an image capturing device. The mounting piece is formed with an opening. The pedestal is arranged on the mounting piece. The pedestal includes multiple support arms rotatably connected to each other. The pedestal is switchable between a folded condition and an expanded condition. The claw part is arranged at one end of the pedestal and rotatable relative to the pedestal. The drive mechanism is electrically connected with the pedestal and the image capturing device. The image capturing device identifies a face position toward which the claw part is moved by the drive mechanism driving the pedestal.

4 Claims, 9 Drawing Sheets

CHAIR STRUCTURE WITH ELECTRONICS SUPPORT FRAME

TECHNICAL FIELD OF THE INVENTION

The present invention relates generally to a chair, and more particularly to a chair structure that includes an electronics support frame.

DESCRIPTION OF THE PRIOR ART

Taiwan Utility Model M543001 discloses a height-adjustable chair seat device, which comprises a base unit, a seat cushion unit, and an elastic cushioning unit. The base unit includes a chassis, an upright tube that is of a hollow tubular form and extends along an axis from the chassis. The seat cushion unit includes a fitting tube that is fit to the upright tube in an inside-outside arrangement, a seat cushion, and a lower quick dismounting assembly. The elastic cushioning unit includes a bottom bar pivoted to the base unit, a top bar pivoted to a top of the fitting tube, and an elastic cushioning body mounted between the bottom bar and the top bar.

However, in the use of the prior art device, if a mobile device (such as a mobile phone or a tablet computer) is being used on the seat, both hands of a user would not be free to do other things. If it is necessary to hand hold other articles or to do other performances or exercises, the hand-held mobile device would cause lots of issues of inconvenience.

SUMMARY OF THE INVENTION

To achieve the above purpose, the present invention provides a chair structure with electronics support frame, which comprises: a chair body, which comprises an armrest; and an electronics support frame, which is located at one side of the armrest. The electronics support frame comprises a mounting piece, a foldable pedestal, a claw part, a drive mechanism, and an image capturing device. The mounting piece is formed with an opening. The pedestal is arranged on the mounting piece. The pedestal comprises a plurality of support arms rotatably connected to each other. The pedestal is switchable between a folded condition and an expanded condition. The claw part is arranged at one end of the pedestal and rotatable relative to the pedestal. The drive mechanism is electrically connected with the pedestal and the image capturing device.

In the chair structure with electronics support frame, the plurality of support arms are rotatably connected by means of a rotary axle, and the claw part and the one end of the pedestal are rotatably connected by means of at least one axle bar, so that the claw part is rotatable relative to the pedestal.

In the chair structure with electronics support frame, a receiving pocket is arranged on one side surface of the mounting piece.

In the chair structure with electronics support frame, the mounting piece is provided with a plurality of connecting pieces that are connectable together, and the connecting pieces comprise buttons, hook-and-loop fasteners, or magnets.

In the chair structure with electronics support frame, the image capturing device comprises an artificial intelligence camera.

As such, the present invention uses the image capturing device to capture an image of a face in order to identify a head position and a face movement, and also uses the drive mechanism to drive the pedestal for switching from the folded condition toward the expanded condition to move the claw part toward the face position and to rotate the claw part toward the face, so that the claw part may clamp and hold a mobile phone or tablet computer to ease conducting of a video conference, while allowing both hands to be free to do various other activities.

DETAILED DESCRIPTION OF THE PREFERRED EMBODIMENT

Figure 1:
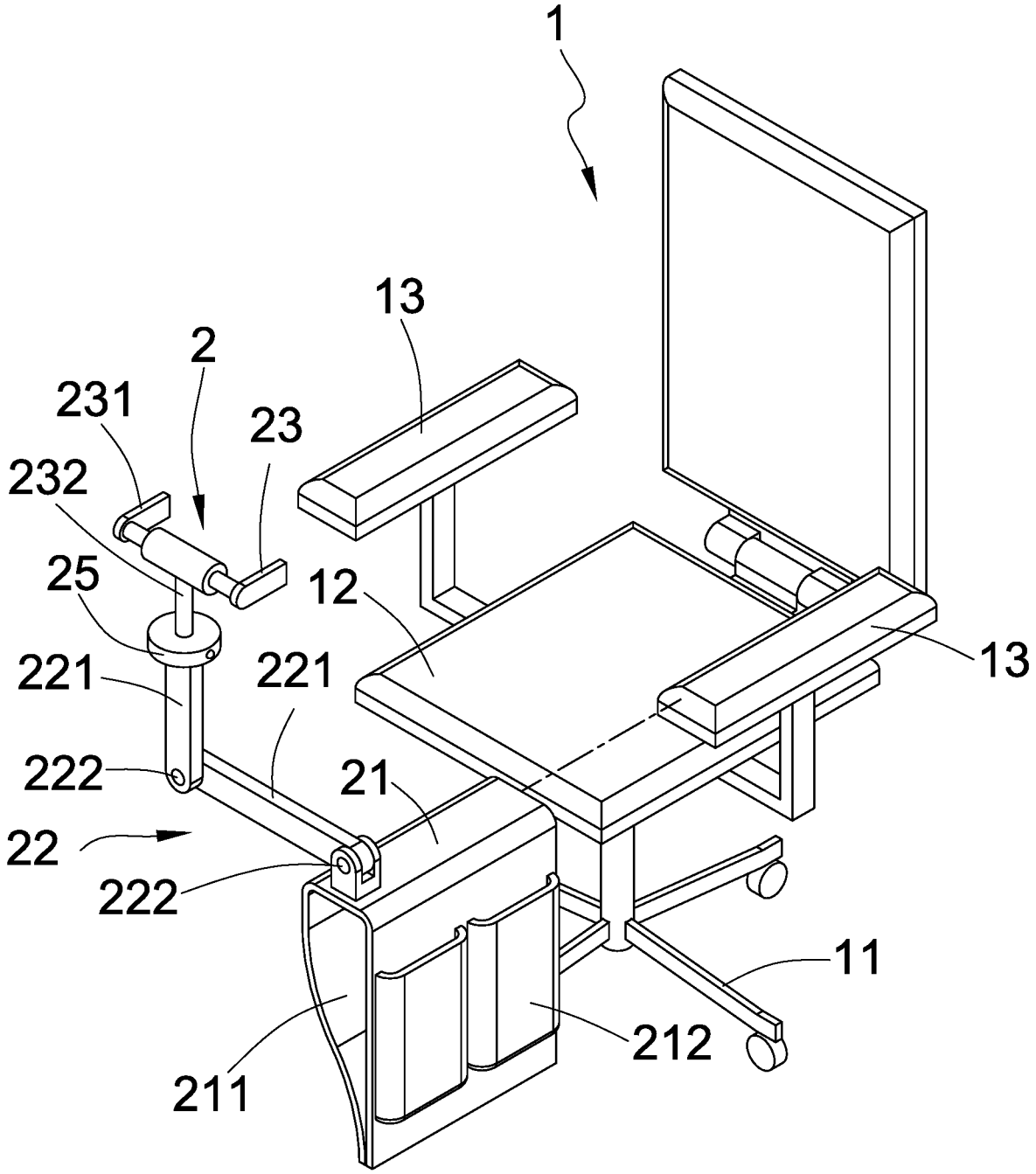
FIG. 1 is a schematic view showing a chair structure including an electronics support frame according to the present invention.

Referring to FIG. 1, the present invention provides a chair structure with electronics support frame, which comprises: a chair body 1 and an electronics support frame 2.

Figure 8:
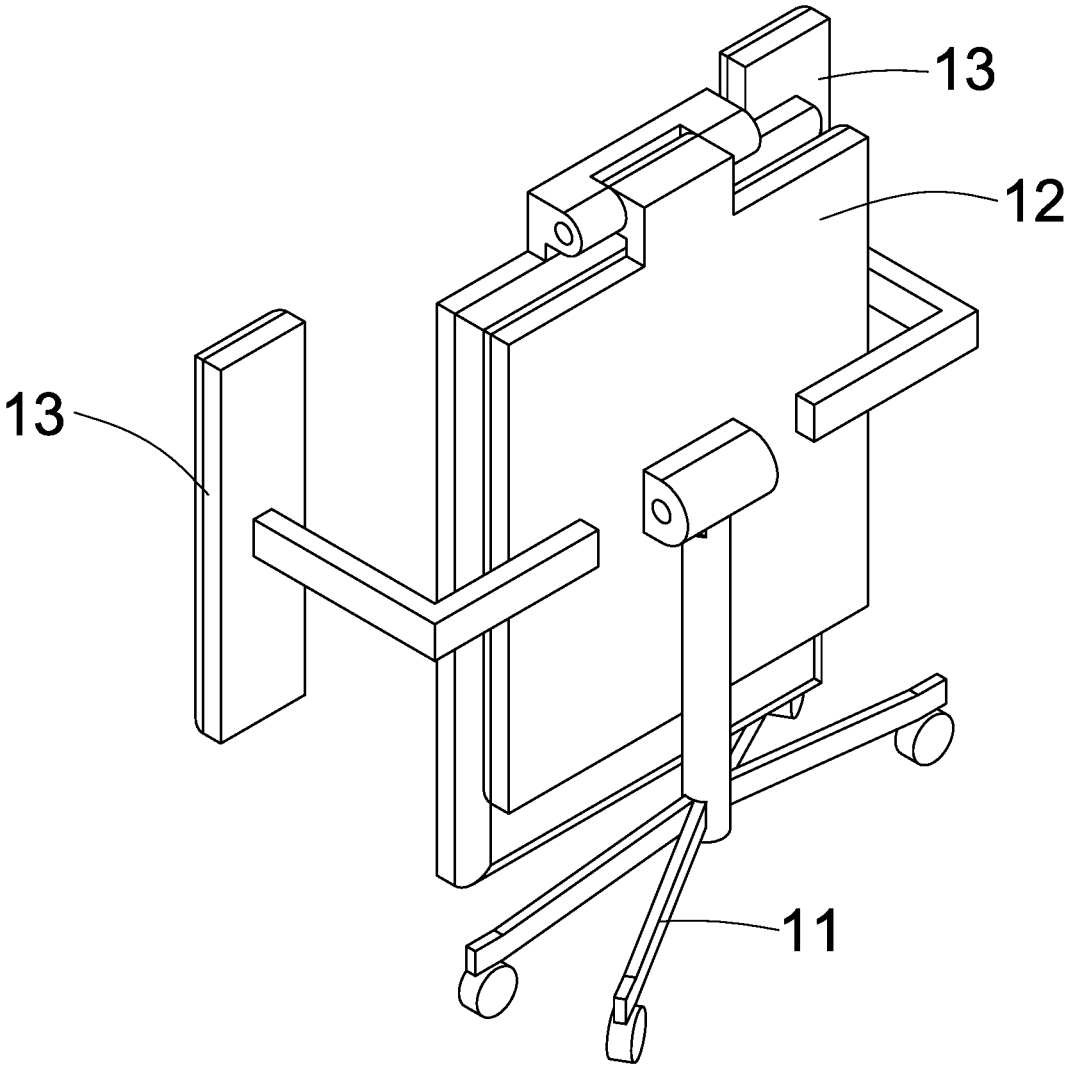
FIG. 8 is a schematic view showing a chair body structured as a foldable chair according to the present invention.

The chair body 1 can be structured as a foldable chair (see FIG. 8). The chair body 1 may comprise a chair base 11 that is positionable on and supported by a floor, a seat 12 arranged on the chair base 11, and at least one armrest 13 arranged at one side of the seat 12.

Figure 2:
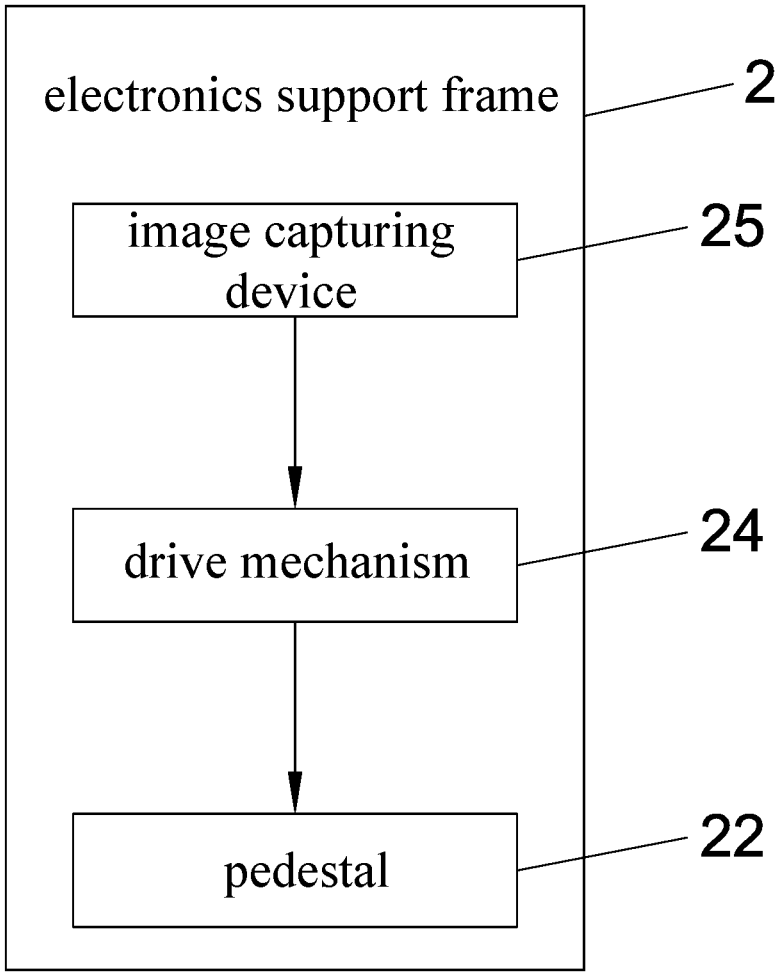
FIG. 2 is a block diagram of the electronics support frame according to the present invention.

Referring to FIGS. 1 and 2, the electronics support frame 2 is located at one side of the armrest 13. The electronics support frame 2 comprises a mounting piece 21, a foldable pedestal 22, a claw part 23, a drive mechanism 24, and an image capturing device 25. The mounting piece 21 is formed with an opening 211. The pedestal 22 is arranged on the mounting piece 21. The pedestal 22 comprises a plurality of support arms 221 that are connected in a manner of being rotatable relative to each other. The pedestal 22 is switchable between a folded condition and an expanded condition. The claw part 23 is arranged at one end of the pedestal 22 and is rotatable relative to the pedestal 22. The drive mechanism 24 is in electrical connection with the pedestal 22 and the image capturing device 25.

Specifically, the plurality of support arms 221 are rotatably connected by means of a rotary axle 222. The claw part 23 and the one end of the pedestal 22 are rotatably connected by means of at least one axle bar, so that the claw part 23 is rotatable relative to the pedestal 22. The at least one axle bar may include a first axle bar 231 and a second axle bar 232. The drive mechanism 24 can be for example a plurality of motors and a motor controller and is mounted inside the pedestal 22. The plurality of motors are respectively coupled with the rotary axle 222, the first axle bar 231, and the second axle bar 232 and the plurality of motors are controlled by the motor controller to respectively drive the rotary axle 222, the first axle bar 231, and the second axle bar 232 to rotate. The image capturing device 25 can be an artificial intelligence camera, and the artificial intelligence camera is operable for fully automatically photographing without manual control.

Figure 3:
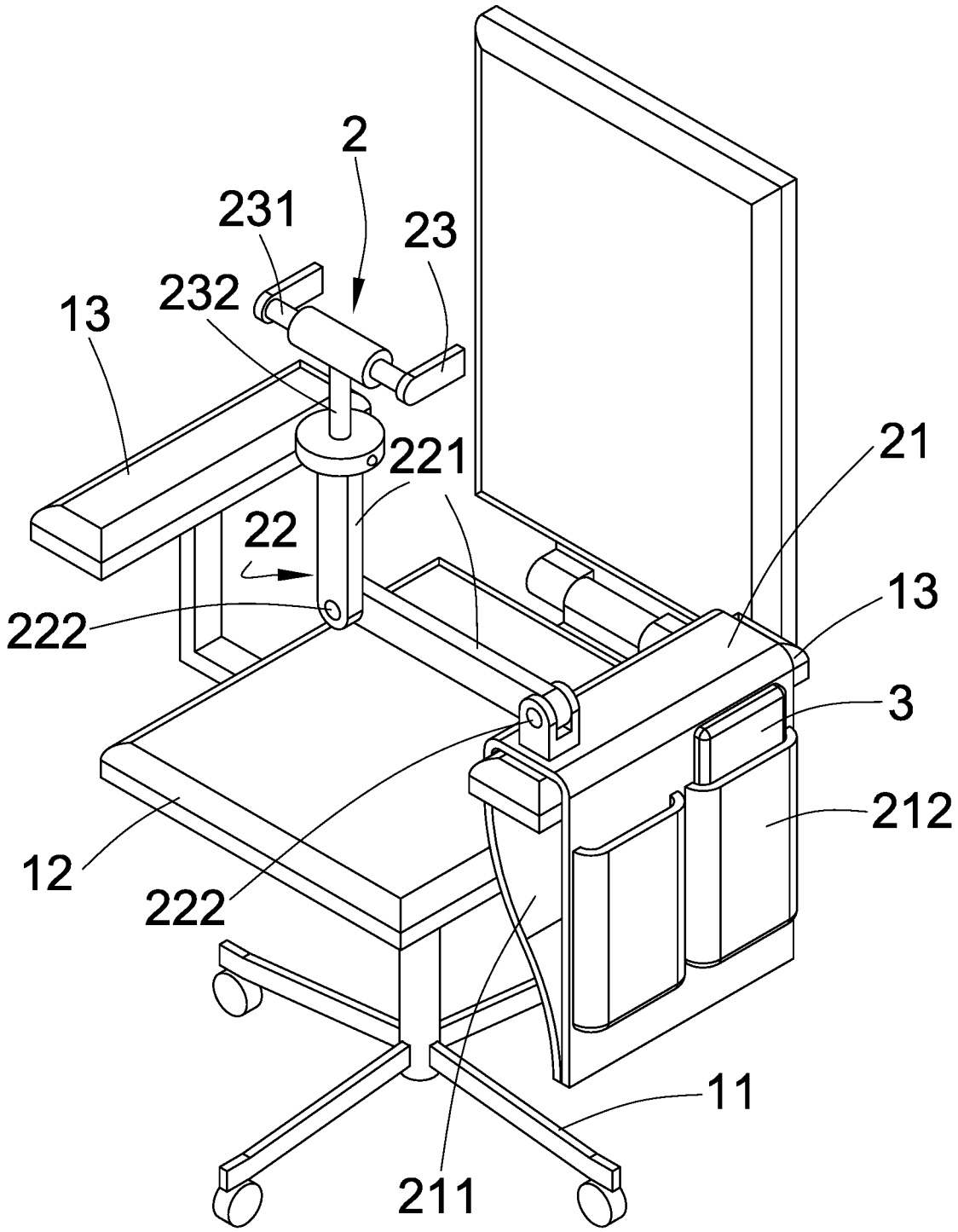
FIG. 3 is a schematic view showing a mobile device received in a receiving pocket according to the present invention.

Referring to FIG. 3, the mounting piece 21 is provided with a receiving pocket 212 arranged on a side surface thereof. The receiving pocket 212 may receive and hold therein a mobile device 3 (such as a mobile phone or a tablet computer).

Figure 4:
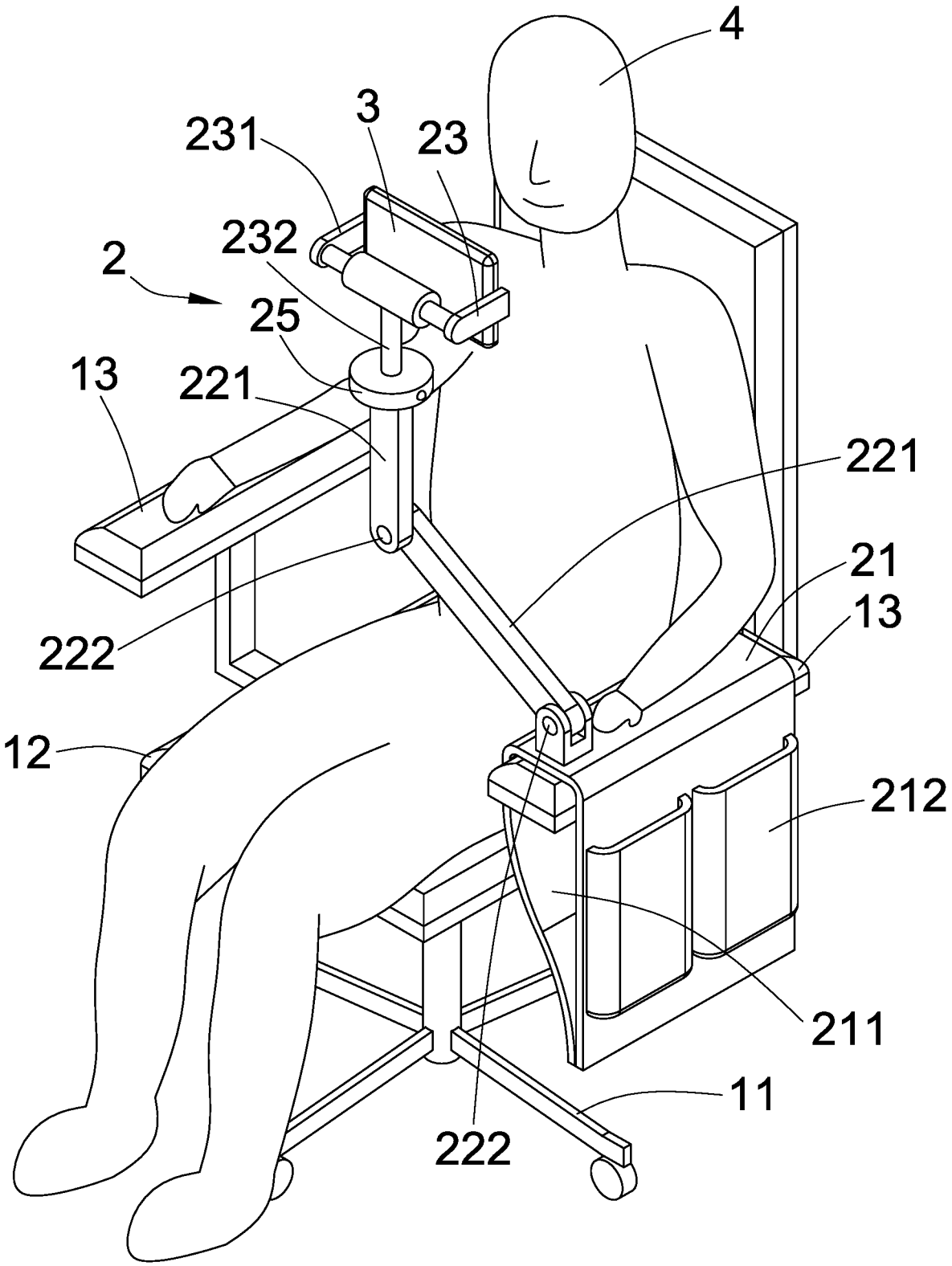
FIG. 4 is a schematic view showing a mounting piece of the electronics support frame receiving an armrest to penetrate therein according to the present invention.

Referring to FIGS. 2 and 4, to use, firstly, a user 4 positions the electronics support frame 2 at one side of the armrest 13, and allows the opening 211 of the mounting piece 21 of the electronics support frame 2 to receive the armrest 13 to penetrate therein, so as to have the electronics support frame 2 mounted to and fixed on the armrest 13. Then, the mobile device 3 is positioned on the claw part 23, so that the claw part 23 may clamp and hold the mobile device 3, and thus, for example, the mobile phone or tablet computer may be operated for conducting a video conference. Further, the image capturing device 25 is operable to capture an image of a face. The image capturing device 25 can be an artificial intelligence camera, which is fully automatically in image capturing and is thus operable to capture an image of a face, and may apply facial recognition technology to identify a face position according to distances among the eyebrows, the eyes, the nose, the teeth, and the mouth and thus determine a head rotating direction. The head rotating direction can be for example head upwards, head downwards, head leftwards, or head rightwards. The image capturing device 25 may then transmit information of the face position and the head rotating direction toward the drive mechanism 24, so that the drive mechanism 24 may drive the pedestal 22 to switch from the folded condition toward the expanded condition, in such a way that the motor controller controls the plurality of motors to have the plurality of motors drive the rotary axle 222 between the plurality of support arms 221 to rotate for causing the pedestal 22 to switch from the folded condition to the expanded condition. After the claw part 23 has been moved to the face position, the drive mechanism 24 rotates the claw part 23 toward the face, in such a way that the motor controller controls the plurality of motors to have the plurality of motors drive the first axle bar 231 or the second axle bar 232. Finally, the user 4 is allowed to use the mobile device 3 held on the claw part 23 to conduct the video conference, while both hands are free to do various other activities.

Figure 5:
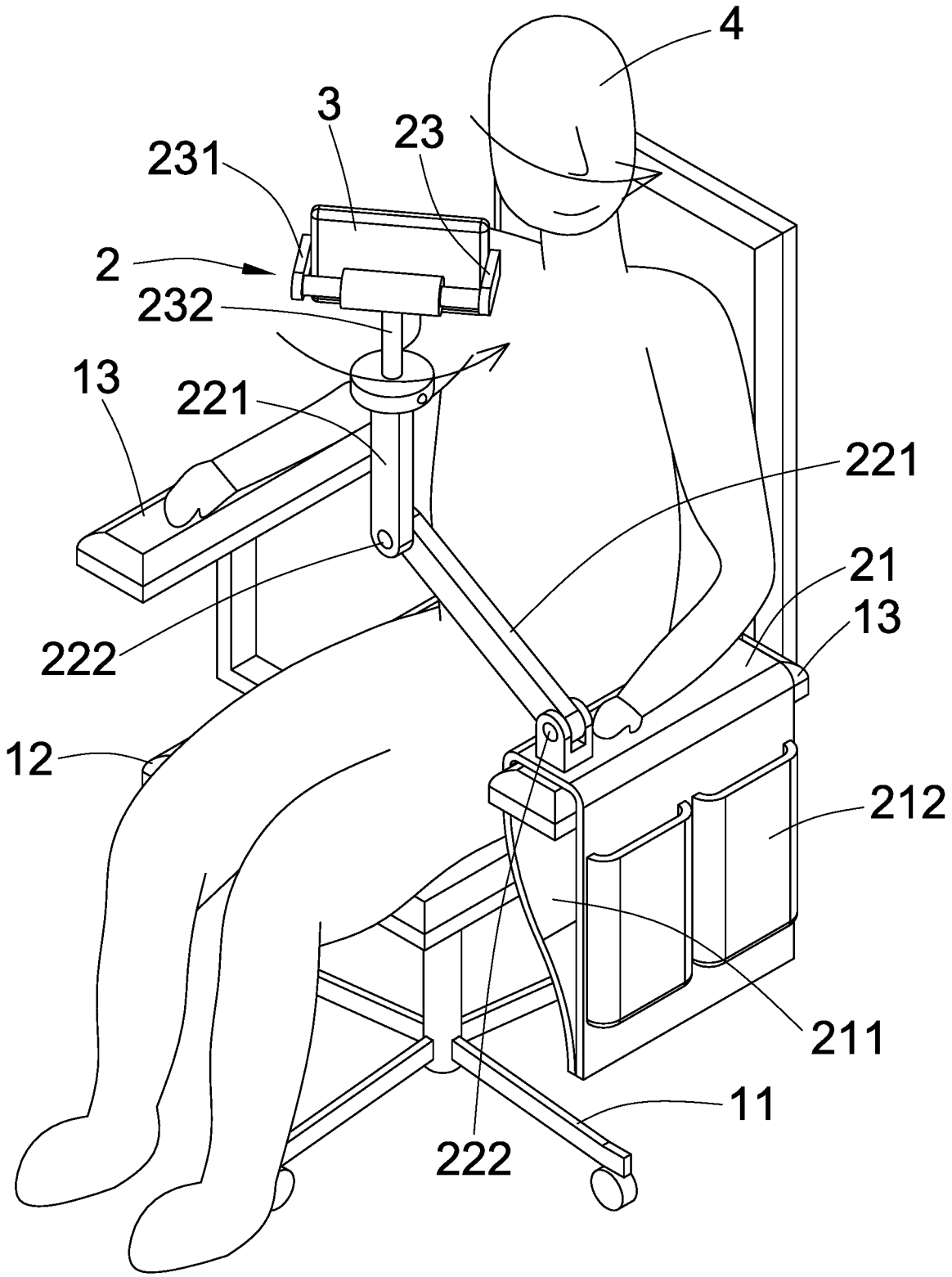
FIG. 5 is a schematic view showing a claw part rotating leftwards/rights relative to a pedestal according to the present invention.
Figure 6:
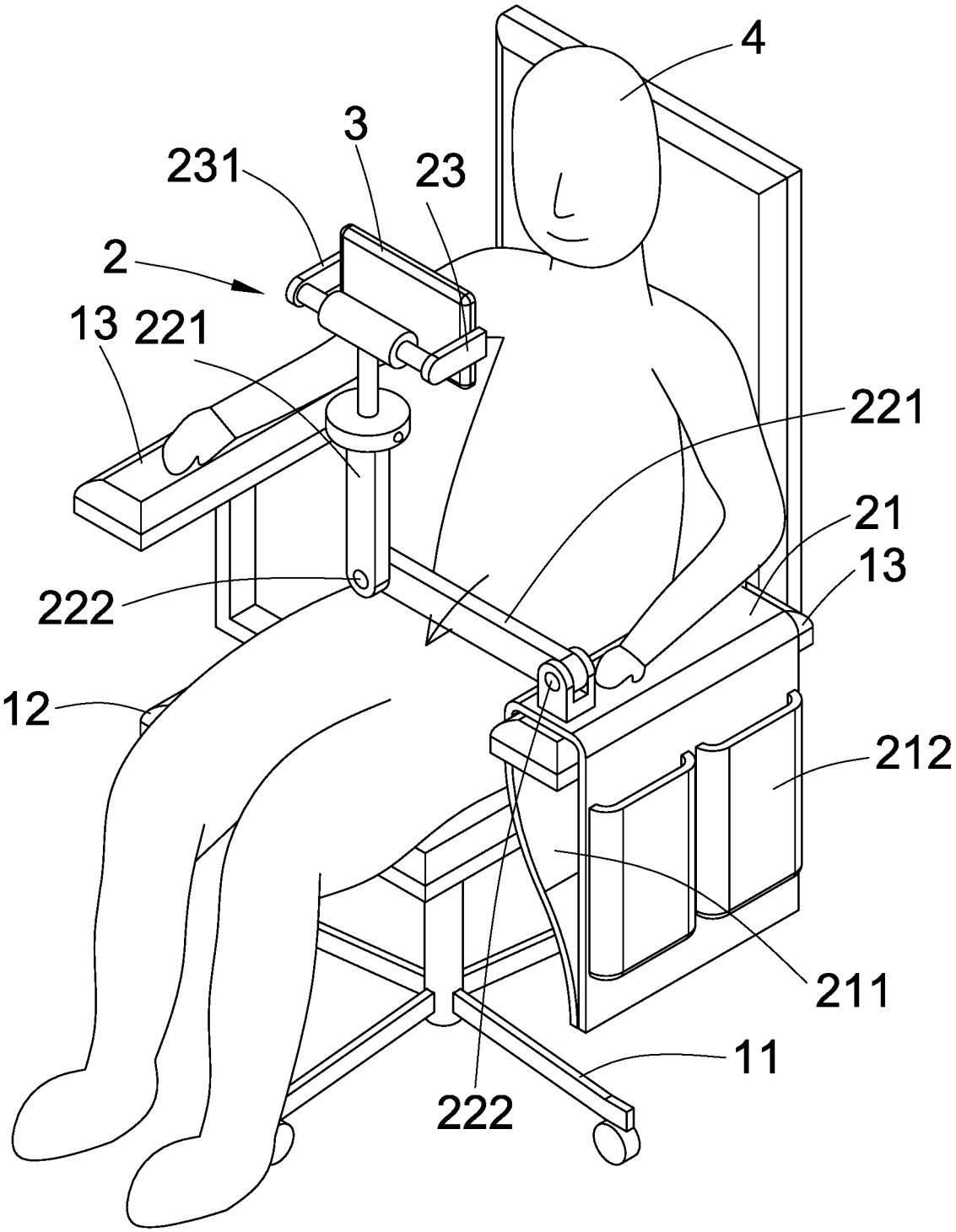
FIG. 6 is a schematic view showing a plurality of support arms of the pedestal moving relative to each other according to the present invention.
Figure 7:
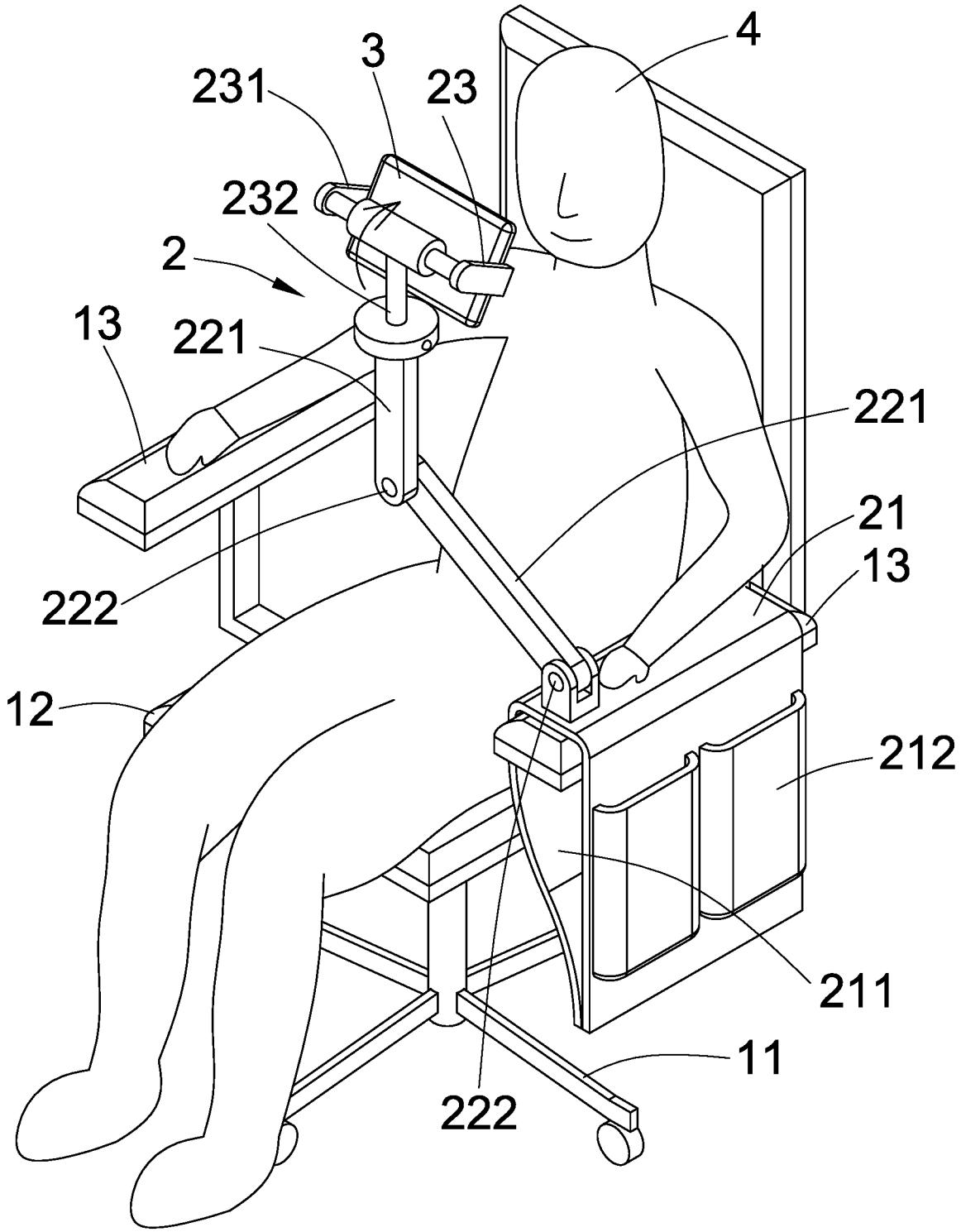
FIG. 7 is a schematic view showing the claw part rotating upwards/downwards relative to the pedestal according to the present invention.

FIG. 5 is a schematic view showing the claw part rotating leftwards/rights relative to the pedestal according to the present invention, in which the face turns toward a right side or the face turns toward a left side so that the claw part 23 is accordingly rotated toward the right side or rotated toward the left side. FIG. 6 is a schematic view showing the plurality of support arms of the pedestal moving relative to each other according to the present invention, in which for a change of the face position or a human body being short, the plurality of support arms 221 of the pedestal 22 are movable relative to each other to move the claw part 23 toward the face position. FIG. 7 is a schematic view showing the claw part rotating upwards/downwards relative to the pedestal according to the present invention, in which the face is set upwards or downwards, and the claw part 23 is accordingly rotated upwards or downwards.

Figure 9:
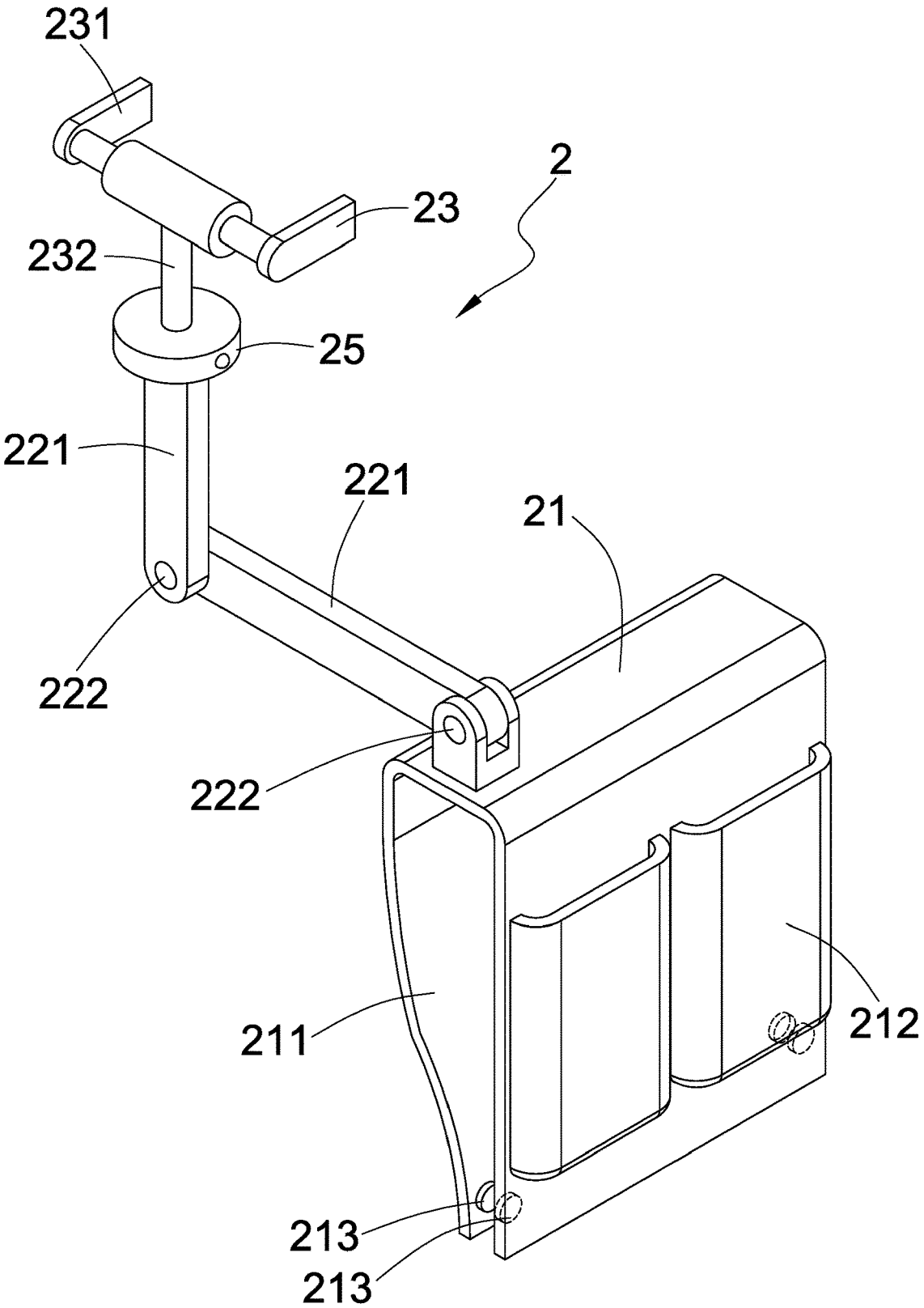
FIG. 9 is a schematic view showing the mounting piece provided with connecting pieces according to the present invention.

In addition, referring to FIGS. 3 and 9, for safety consideration, the mounting piece 21 is provided with a plurality of connecting pieces 213 that are connectable together. The connecting pieces 213 can be buttons, hook-and-loop fasteners, or magnets, which help prevent the mounting piece 21, in receiving the armrest 13 to penetrate therein, from accidently falling to have the electronics support frame 2 hit a person.

As such, the present invention uses the image capturing device 25 to capture an image of a face in order to identify a face position and a face movement, and also uses the drive mechanism 24 to drive the pedestal 22 for switching the folded condition toward the expanded condition to move the claw part 23 toward the face position and to rotate the claw part 23 toward the face, so that the claw part 23 may clamp and hold a mobile phone or tablet computer to ease conducting of a video conference, while allowing both hands to be free to do various other activities.

I claim:

1. A chair structure with electronics support frame, comprising:

a chair body, which comprises an armrest; and an electronics support frame, which is located at one side of the armrest, the electronics support frame comprising a mounting piece, a foldable pedestal, a claw part, a drive mechanism, and an image capturing device, the mounting piece being formed with an opening, the pedestal being arranged on the mounting piece, the pedestal comprising a plurality of support arms rotatably connected to each other, the pedestal being switchable between a folded condition and an expanded condition, the claw part being arranged at one end of the pedestal and rotatable relative to the pedestal, the drive mechanism being electrically connected with the pedestal and the image capturing device; wherein a receiving pocket is arranged on one side surface of the mounting piece.

2. The chair structure with electronics support frame according to claim 1, wherein the plurality of support arms are rotatably connected by means of a rotary axle, and the claw part and the one end of the pedestal are rotatably connected by means of at least one axle bar, so that the claw part is rotatable relative to the pedestal.

3. The chair structure with electronics support frame according to claim 1, wherein the mounting piece is provided with a plurality of connecting pieces that are connectable together, and the connecting pieces comprise buttons, hook-and-loop fasteners, or magnets.

4. The chair structure with electronics support frame according to claim 1, wherein the image capturing device comprises an artificial intelligence camera.

* * * * *